US006418746B1

(12) United States Patent
Dokoshi

(10) Patent No.: US 6,418,746 B1
(45) Date of Patent: Jul. 16, 2002

(54) STORAGE EQUIPMENT AND STORAGE METHOD

(75) Inventor: Jun Dokoshi, Sapporo (JP)

(73) Assignee: Daicolo Co., Ltd., Osaka (JP)

( * ) Notice: Subject to any disclaimer, the term of this patent is extended or adjusted under 35 U.S.C. 154(b) by 0 days.

(21) Appl. No.: 09/600,765

(22) PCT Filed: Jan. 21, 1999

(86) PCT No.: PCT/JP99/00235

§ 371 (c)(1),
(2), (4) Date: Aug. 31, 2000

(87) PCT Pub. No.: WO99/37959

PCT Pub. Date: Jul. 29, 1999

(30) Foreign Application Priority Data

Jan. 22, 1998 (JP) ..... 10-048520
Feb. 2, 1998 (JP) ..... 10-001351
Jan. 12, 1999 (JP) ..... 11-005257

(51) Int. Cl.[7] ..... F25D 17/02
(52) U.S. Cl. ..... 62/434; 62/406; 62/425
(58) Field of Search ..... 62/337, 338, 339, 62/430, 434, 406, 425

(56) References Cited

U.S. PATENT DOCUMENTS 5,243,834 A * 9/1993 Hachinohe et al ..... 62/434

FOREIGN PATENT DOCUMENTS

| | | | |
|---|---|---|---|
| JP | 6170361 | A | 4/1986 |
| JP | 330629 | A | 2/1991 |
| JP | 7243740 | A | 9/1995 |
| JP | 8256589 | A | 10/1996 |
| JP | 9156772 | A | 6/1997 |

* cited by examiner

*Primary Examiner*—Denise L. Esquivel
*Assistant Examiner*—Melvin Jones
(74) *Attorney, Agent, or Firm*—Webb Ziesenheim Logsdon Orkin & Hanson, P.C.

(57) ABSTRACT

A storage system comprises: a heat-insulating outer shell (1) capable of insulating inner space (V); an ice storage water tank (4) capable of storing water therein disposed in an ice storage water tank disposing space (5) provided in the inner space (V) of the heat-insulating outer shell (1); a storage space (3) for storing objects (2) to be stored provided in the inner space (V) of the heat-insulating outer shell (1); an outside-air inlet opening (1*a*) provided at a lower portion of the heat-insulating outer shell (1), the inlet opening being capable of introducing outside air into the inner space (V); an inside-air outlet opening (1*b*) provided at an upper portion of the heat-insulating outer shell (1), the outlet opening being capable of discharging inside air from the inner space (V) of the heat-insulating outer shell (1) to the outside; and an object entrance-exit opening (7) provided at an upper portion of the heat-insulating outer shell (1) for allowing entrance-exit of the objects (2) to and from the storage space (3).

12 Claims, 10 Drawing Sheets

STORAGE EQUIPMENT AND STORAGE METHOD

BACKGROUND OF THE INVENTION

1. Field of the Invention

The present invention relates to a storage facility and a storage method using the storage facility. For example, the invention relates to a storage facility and a storage facility involving low-temperature, high-humidity storage of an object to be stored (e.g. agricultural product such as potato, vegetable, fruits, etc.), or precooling of vegetable, and also to a storage method using the system.

2. Description of the Prior Art

As the conventional storage facility and storage method of the above-noted type, there are known the system and method utilizing the direct-cooling refrigerating cycle. For example, there is known a system and method utilizing such direct-cooling refrigerating cycle from e.g. Japanese laid-open patent gazette No. Hei. 5-26557.

Basically, this system is designed to maintain low temperature by absorbing respiration heat of the vegetable stored inside a storage house. Accordingly, for reducing the temperature its inside, this system employs a moisture permeable film (Japanese laid-open patent gazette No. Hei. 6-74646) for maintaining moisture or additionally includes a humidifier (Japanese laid-open patent gazette No. Hei. 8-42960), for forcibly increasing the humidity.

As a small-scale storage, there is known a system referred to icehouse. According to this, in a snowfall region, a hole is dug in the earth, Into this hole, vegetables are introduced, on which snow is put for storage. In recent years, as exemplified by e.g. Japanese patent gazette No. 2598574, there have been attempts in cold districts such as storage facility/storage method in which a heat-exchanger pipe is employed for cooling inside of a storage house in which agricultural products are stored, or storage facility/storage method in which a heat pipe having good cold conducting property during winter time is employed for making artificial frozen soil to be used as cold source (Japanese laid-open patent gazette No. Hei. 7-218080).

Further, regarding precooling, as exemplified by Japanese published patent gazette No. Hei. 7-99991, there is storage facility/storage method in which a product is sealed in a plastic bag to be cooled.

According to the conventional art described above, there is required a significant amount of electricity since a large refrigerator is employed as the ice making machine. Also, in the conventional storage facility too, there is the problem of large consumption of electricity since refrigerating cycle is employed as the heat source. Moreover, in he case of such method using refrigerating cycle, in order to maintain the low temperature inside the storage house of the vegetables, not only the respiration heat is absorbed from the vegetables, but also significant dehydration of the vegetables occurs as the result. Hence, a humidifier or the like needs to be employed, but, this too adds to the electricity consumption.

Further, in order to solve the problem of electricity consumption by the refrigerating cycle, it it conceivable to employ the system called icehouse using snow. However, the density of snow has such small value as 0.27 approximately. Then, in order to adapt it to the system/method, an extremely large amount of snow needs to be prepared and also a large-scale facility too will be necessary for storing the snow. As a result, significant costs will be needed for transportation of snow and building of the facility. Also, in cold districts without snow accumulation, the snow must be transported from a distant place, hence leading to especially high costs.

Therefore, an object of the present invention is to provide a storage facility/storage method solving the above-described problems, not requiring large amount of electricity, suitable of multiple of purposes, allowing storage of storage objects kept under good storage conditions.

SUMMARY OF THE INVENTION

According to FIGS. 4–8 and 11, the system comprises a heat-insulating outer shell capable of insulating inner space; an ice storage water tank capable of storing water therein disposed in an ice storage water tank disposing space provided in the inner space of the heat-insulating outer shell; a storage space for storing objects to be stored provided in the inner space of the heat-insulating outer shell; an outside-air inlet opening provided at a lower portion of the heat-insulating outer shell, the inlet opening being capable of introducing outside air into the inner space; an inside-air outlet opening provided at an upper portion of the heat-insulating outer shell, the outlet opening being capable of discharging inside air from the inner space of the heat-insulating outer shell to the outside; and an object entrance-exit opening provided at an upper portion of the heat-insulating outer shell for allowing entrance-exit of the objects to and from the storage space.

According to one feature of the invention defined in claim 1, when the outer air becomes sub-zero condition, the outer air enters through the outside-air inlet opening into the ice storage water tank disposing space, so that the air absorbs latent heat from the water stored in the ice storage water tank for freezing this water. Further, the air contacting the ice storage water tank, by absorbing latent heat from the water, experiences temperature rise, and due to reduction of its density associated therewith, the air is caused to rise in the inner space of the heat-insulating outer shell to be discharged through the inside-air outlet opening to the outside.

Therefore, within the inner space of the heat-insulating outer shell, there is generated upward air current due to the transfer of latent heat associated with freezing of the water, so that the introduction of outside air into the ice storage water tank disposing space and discharge thereof can take place in automatic and continuous manner. Thus, it has become possible to freeze the water inside the ice storage water tank by utilizing the cold source of the cold district which is the natural resource of the earth. Hence, ice can be made inexpensively and energy can be saved, so that the system can contribute significantly to the reduction of carbon dioxide gas output on the earth.

And, by the cold from the ice made in the ice storage water tank disposing space, the storage space can be maintained under refrigerating condition (about 0° C.), for allowing storage objects stored in the storage space.

Moreover, since the storage space can be maintained at a high humidity by means of saturated water vapor pressure, storage of objects under low-temperature, high-humidity environment can be realized.

Therefore, it becomes possible to provide an environment suitable for storage of agricultural products (potatoes, vegetables, fruits, live flowers, etc). Furthermore, since the storage space can be maintained at the temperature of 0° C. approximately, the system may be used also for freezing storage of frozen articles frozen below zero.

Further, due to the relationship between the temperature and density of the air (i.e. the lower the temperature, the higher the humidity), even if the entrance-exit opening is kept open during the entry or exit of the objects into or from the storage space, in case the outside air temperature is higher than the inside air temperature of the storage space, it is possible to minimize entry of the outside air into the inner space of the heat-insulating outer shell.

Therefore, it becomes possible to minimize the leak of the cool air of the storage space to the outside, so that the temperature of the storage space can be maintained easily.

Next, the above-described freezing of water utilizing latent heat will be described with reference to FIG. 1(*a*).

The figure records temperature variation relative to time base occurring in water placed in a vat disposed inside a freezer. When the temperature of the freezer becomes below 0° C., the temperature of the water in the vat is kept at 0° C. approximately. Upon lapse of certain time, however, the water changes into ice and the temperature becomes below 0° C. gradually. However, as shown in FIG. 1(*b*), the temperature of the substance in the vat not radiating latent heat therefrom follows the temperature of the freezer. This experimental fact is demonstrated by FIG. 2. When the outside temperature falls toward point B, the temperature of water becomes 0° and some of the water changes into ice and the energy discharged during this process is called latent heat. This latent heat discharges energy of 80 Kcal per 1 kg of water until the point A is reached where the water is frozen completely. With additional cooling after completion of discharge of latent heat, the ice becomes below 0° C. This phenomenon is reversible. Conversely, water becomes 0° C. by giving its heat to ice. The ice receives the heat, but is maintained at 0° C. until it receives 80 Kcal per 1 kg. Such received heat too is called latent heat. The present invention utilizes mainly the condition between the point A and the point B. The large heat capacities of water and ice contributes greatly to the maintenance of 0° C. environment, that is the system being less susceptible to the outside temperature.

According to one feature of the present invention as exemplified by the illustrations of FIGS. 5, 7 and 11, the system comprises: a heat-insulating outer shell capable of insulating inner space; an ice storage water tank capable of storing water therein disposed in an ice storage water tank disposing space provided in the inner space of the heat-insulating outer shell; a storage space for storing objects to be stored provided in the inner space of the heat-insulating outer shell; an outside-air inlet opening provided at a lower portion of the heat-insulating outer shell, the inlet opening being capable of introducing outside air into the inner space; and an inside-air outlet opening provided at an upper portion of the heat-insulating outer shell, the outlet opening being capable of discharging inside air from the inner space of the heat-insulating outer shell to the outside, wherein the ice storage water tank disposing space is disposed so as to encompass the storage space.

Another feature of the invention is that it has become possible to freeze the water without using a blower driving unit or freezer inside the ice storage water tank by utilizing the cold source of the cold district which is the natural resource of the earth. Hence, ice can be made inexpensively and energy can be saved, so that the system can contribute significantly to the reduction of carbon dioxide gas output on the earth, and storage of objects under low-temperature, high-humidity environment can be realized.

Moreover, as the ice storage water tank disposing space is interposed between the storage space and the outside, the ice storage water tank disposing space not only provides cold to the storage space, but also guards the storage space, whereby the influence from the environmental change of the outside air to the storage space may be advantageously reduced. Therefore, it becomes possible to maintain the storage of the storage object under more favorable conditions for a longer time.

Accordingly, it becomes possible to provide an environment suitable for storage of agricultural products (potatoes, vegetables, fruits, live flowers, etc). Furthermore, the system may be used also for freezing storage of frozen articles frozen below zero.

According to another feature of the present invention as exemplified by the illustrations of FIGS. 5, 7 and 11, the system comprises: a heat-insulating outer shell capable of insulating inner space; an ice storage water tank capable of storing water therein disposed in an ice storage water tank disposing space provided in the inner space of the heat-insulating outer shell; a storage space for storing objects to be stored provided in the inner space of the heat-insulating outer shell; an outside-air inlet opening provided at a lower portion of the heat-insulating outer shell, the inlet opening being capable of introducing outside air into the inner space; and an inside-air outlet opening provided at an upper portion of the heat-insulating outer shell, the outlet opening being capable of discharging inside air from the inner space of the heat-insulating outer shell to the outside, wherein the heat-insulating outer shell has a cylindrical shape.

According to another feature of the invention it has become possible to freeze the water inside the ice storage water tank without using a blower driving unit or freezer by utilizing the cold source of the cold district which is the natural resource of the earth. Hence, ice can be made inexpensively and energy can be saved, so that the system can contribute significantly to the reduction of carbon dioxide gas output on the earth, and storage of objects under low-temperature, high-humidity environment can be realized.

Moreover, due particularly to the cylindrical shape of the heat-insulating outer shell, the shell has a circular cross section. Hence, in order to obtain a predetermined inner space capacity, it is possible to reduce the surface area of the wall, in comparison with one having a rectangular cross section. As a result, heat loss through the wall surface may be reduced, thereby to restrict thawing of the ice during warm season. Thus, the use amount of insulating material may be minimized, the heat insulting is two-dimensional and the volume of the ice is three-dimensional. For this reason, the larger the system, the smaller the amount of ice needed and the smaller the thickness of the heat insulating material. That is, there is achieved the effect of realization of construction cost reduction per unit storage amount.

Moreover, such circular shape has less resistance against an external force such as wind pressure against the wall surface, and the external force will be broken up into force components along the wall surface, which can be absorbed by compression stress of the material forming the wall surface. Hence, the shape is reasonable from the dynamics point of view. So that, through simplification of the building facility, the construction costs may be reduced advantageously.

According to another feature of the present invention, as exemplified by the illustrations of FIGS. 5, 7 and 11, the heat-insulating outer shell has a cylindrical shape.

According to yet another feature of the invention, in addition to the achievement of the function/effects by the invention, the heat-insulating outer shell has a circular cross section. Hence, in order to obtain a predetermined inner space capacity, it is possible to reduce the surface area of the wall, in comparison with one having a rectangular cross section. As a result, heat loss through the wall surface may be reduced, thereby to restrict thawing of the ice during warm season. Thus, the use amount of insulating material may be minimized, the heat insulting is two-dimensional and the volume of the ice is three-dimensional. For this reason, the larger the system, the smaller the amount of ice needed and the smaller the thickness of the heat insulating material. That is, there is achieved the effect of realization of construction cost reduction per unit storage amount.

Moreover, such circular shape has less resistance against an external force such as wind pressure against the wall surface, and the external force will be broken up into force components along the wall surface, which can be absorbed by compression stress of the material forming the wall surface. Hence, the shape is reasonable from the dynamics point of view. So that, through simplification of the building facility, the construction costs may be reduced advantageously.

According to yet another feature of the present invention, as exemplified by the illustrations of FIGS. 5, 7 and 11, the ice storage water tank disposing space is disposed so as to encompass the storage space.

According to yet another feature of the invention, the function/effect by the invention can be achieved. In addition, as the ice storage water tank disposing space is interposed between the storage space and the outside, the ice storage water tank disposing space not only provides cold to the storage space, but also guards the storage space, whereby the influence from the environmental change of the outside air to the storage space may be advantageously reduced. Therefore, it becomes possible to continue to provide storage for the storage objects under even better conditions for a longer period of time. Incidentally, such encompassing condition of the storage space may include various conditions such as a condition in which only a lateral side of the storage space is encompassed, a further condition in which the space is encompassed, including its lower side, and a still further condition in which the space is encompassed entirely, including all of its upper, lower and lateral sides.

According to yet another feature of the present invention, as exemplified by the illustrations of FIGS. 5, 7 and 11, the system further comprises a loading-unloading equipment capable of transporting the storage object through the entrance/exit opening.

That is, the carry-in and carry-out operations of the storage objects may be carried out speedily and efficiently. So that, the operating time period of the entrance-exit opening during the carry-in or carry-out operation of the storage object may be shortened, thereby to reduce wasteful leak of the cold air from the inside of the storage facility. And, the temperature maintenance of the storage space may be effected more easily.

According to yet another feature of the present invention, as exemplified by the illustrations of FIGS. 9 and 10, the system comprises: a heat-insulating outer shell capable of insulating inner space; an ice storage water tank capable of storing water therein disposed in an ice storage water tank disposing space provided in the inner space of the heat-insulating outer shell; a storage space for storing objects to be stored provided in the inner space of the heat-insulating outer shell; an outside-air inlet opening provided at a lower portion of the heat-insulating outer shell, the inlet opening being capable of introducing outside air into the inner space; an inside-air outlet opening provided at an upper portion of the heat-insulating outer shell, the outlet opening being capable of discharging inside air from the inner space of the heat-insulating outer shell to the outside; an object entrance-exit opening provided at an upper portion of the heat-insulating outer shell for allowing entrance-exit of the objects to and from the storage space; and a blower means W capable of being driven to selectively provide an outside air introducing state for introducing outside through the outside-air inlet opening into the ice storage water tank disposing space and an inside air circulating state for circulating the air between the ice storage water tank disposing space and the storage space.

According to another feature of the invention, when the outside air is under low temperature, by switching the blower means to the outside air introducing state, outside air is introduced through the outside-air inlet opening into the ice storage water tank disposing space, so that this air absorbs latent heat from the water stored within the ice storage water tank for freezing this water.

Thus, it has become possible to freeze the water inside the ice storage water tank by utilizing the cold source of the cold district which is the natural resource of the earth. Hence, ice can be made inexpensively and energy can be saved, so that the system can contribute significantly to the reduction of carbon dioxide gas output on the earth. And, by the cold from the ice made in the ice storage water tank disposing space, the storage space can be maintained under refrigerating condition (about 0° C.), for allowing storage objects stored in the storage space.

Moreover, since the storage space can be maintained at a high humidity by means of saturated water vapor pressure, storage of objects under low-temperature, high-humidity environment can be realized.

Therefore, it becomes possible to provide an environment suitable for storage of agricultural products (potatoes, vegetables, fruits, live flowers, etc). Furthermore, since the storage space can be maintained at the temperature of 0° C. approximately, the system may be used also for freezing storage of frozen articles frozen below zero.

Further, due to the relationship between the temperature and density of the air (i.e. the lower the temperature, the higher the humidity), even if the entrance-exit opening is kept open during the entry or exit of the objects into or from the storage space, in case the outside air temperature is higher than the inside air temperature of the storage space, it is possible to minimize entry of the outside air into the inner space of the heat-insulating outer shell. Hence, the maintenance of the temperature of the storage space may be effected easily.

Moreover, as the ice storage water tank disposing space is interposed between the storage space and the outside, the ice storage water tank disposing space not only provides cold to the storage space, but also guards the storage space, whereby the influence from the environmental change of the outside air to the storage space may be advantageously reduced. Accordingly, it becomes possible to continue to provide storage for the storage objects under even better conditions for a longer period of time.

On the other hand, by setting the blower means under the inside air circulating state, the cold stored in the ice storage water tank may be provided to the storage space for maintaining the refrigerating condition of this storage space.

Therefore, even in the presence of cold season or warm season, the refrigerated storage may be carried out continuously.

According to another feature of the invention, the storage facility is prepared. Then, water is charged into the ice storage water tank. When the outside air becomes sub-zero temperature, the outside-air inlet opening and the inside-air outlet opening are rendered communicable, so as to introduce the outside air into the ice storage water tank disposing space, so that the cold of this outside air may freeze the water for maintaining the ambience temperature of the storage space at a refrigerating condition. Thereafter, while the outside-air inlet opening is kept closed, the storage object is introduced through the entrance-exit opening into the storage space to be stored therein.

That is, by utilizing the natural environment, ice, whether in a small amount or in a large amount, can be made for multiple purposes, without requiring a large amount of electricity, and by using this ice the ambient temperature of the storage space may be maintained under the refrigerating condition, so that the storage objects stored in the storage space may be stored under low-temperature, high-humidity condition in a stable manner.

Further, if the amount of ice to be made is designed such that the amount is large enough not to be completely melted even when subjected to heat during the spring, summer and autumn seasons when the outside temperature is high, water and ice can coexist within the ice storage water tank throughout the spring, summer and autumn seasons. Therefore, as shown in FIG. 2, whole-year vegetables can be stored under low temperature.

And, by minimizing heat loss associated with entry and exit of the storage objects, storage of the storage objects is made possible with maintaining the refrigerating environment stable for a longer period of time.

BEST MODE OF EMBODYING THE INVENTION

The present invention will now be described in details, with reference to the accompanying drawings.

[First Embodiment]

Figure 3:
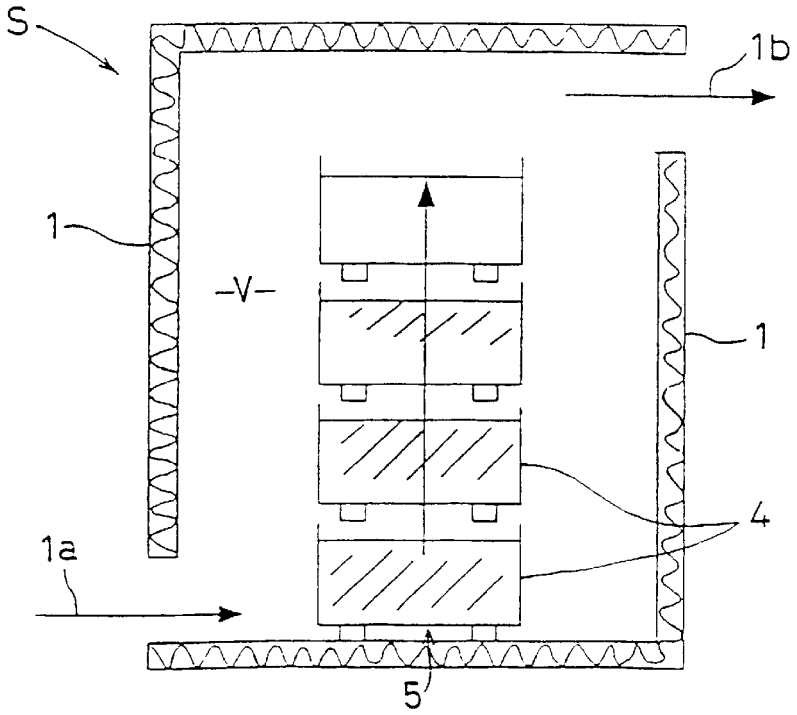
FIG. 3 is an explanatory view illustrating the concept of ice making.
Figure 4:
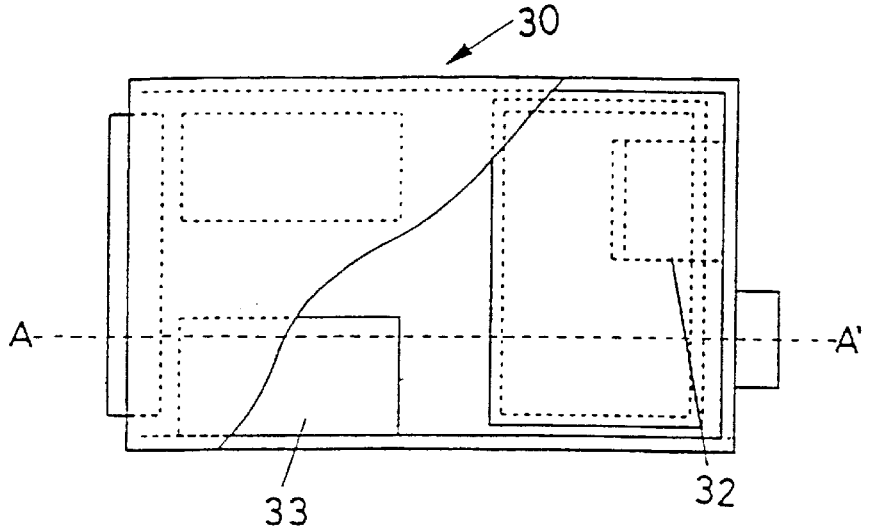
FIGS. 4 are construction views of a basic embodiment of low-temperature, high-humidity storage house relating to the present invention; in which, (a) is a section along AA' in FIG. 4(*b*) and (b) is a section along BB' in FIG. 4(*a*).
Figure 4:
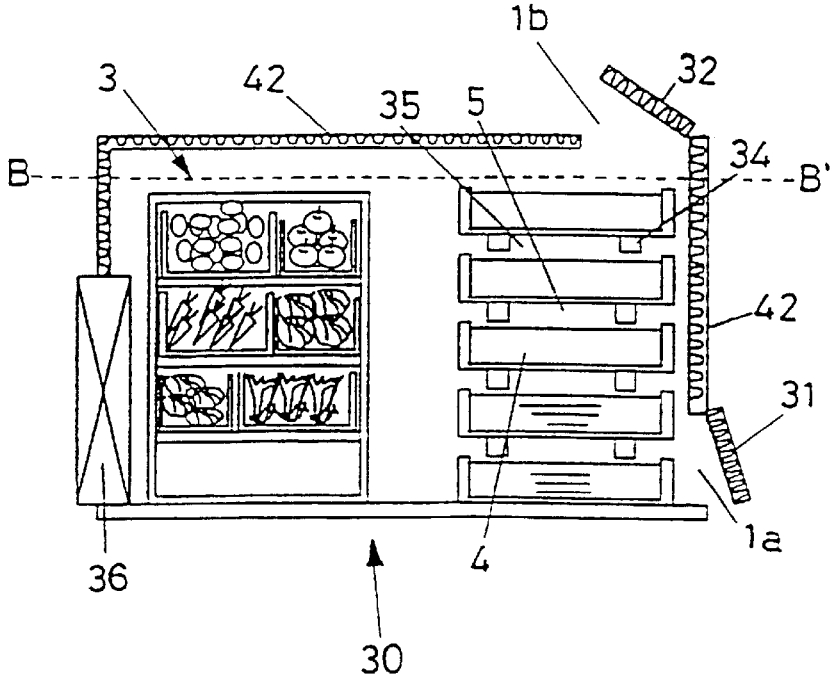

An embodiment of a low-temperature, high-humidity storage house according to the present invention will be described with reference to FIG. 4. This is an embodiment in which the storage house is installed under the ground of a house. A storage space 3 is provided inside a building structure having heat-insulated construction. After ice is made by an ice maker described later with reference to FIG. 3, an outside-air inlet opening 1*a* and an inside-air outlet opening 1*b* are closed respectively by an air-inlet damper 31 and an air-outlet damper 32. The degree of heat insulation provided by a heat-insulating wall 42 should be such that the insulating material has a thickness sufficient to prevent the ice from being melted until a desired time during a warm season, due to reception of heat. In the case of this embodiment, it is preferred that after the making of ice, the temperature of the storage space 3 be monitored and storage into the storage space be waited until the temperature becomes 0° C. approximately due to reception of heat from the outside. Alternatively, if a sufficient amount of water is present in an ice storage water tank so that ice and water can coexist, as such coexistence of ice and water occurs at 0° C., then, in condition, the storage space 3 can be maintained under high humidity by the saturated water vapor from the ice storage water tank 4. However, at the border of the heat insulating wall on the inner side of the storage space 3, because the temperature is same as that of the space, no supersaturation occurs, hence, no dew concentration occurs.

Incidentally, inside the ice storage water tank 4, there are formed gaps 35 by means of spacers 34. Further, the heat insulating building construction 30 includes a carry-in carry-out door 36 and storage shelves 33.

Figure 5:
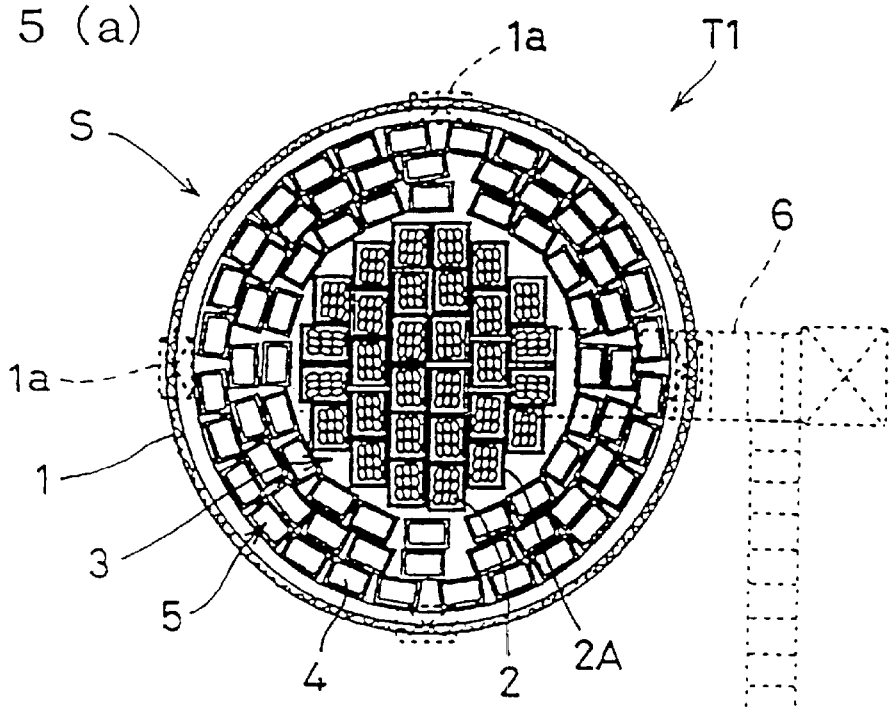
FIG. 5 are explanatory views illustrating a storage facility relating to a first embodiment; in which (a) is a plan view and (b) is a side view in section.
Figure 5:
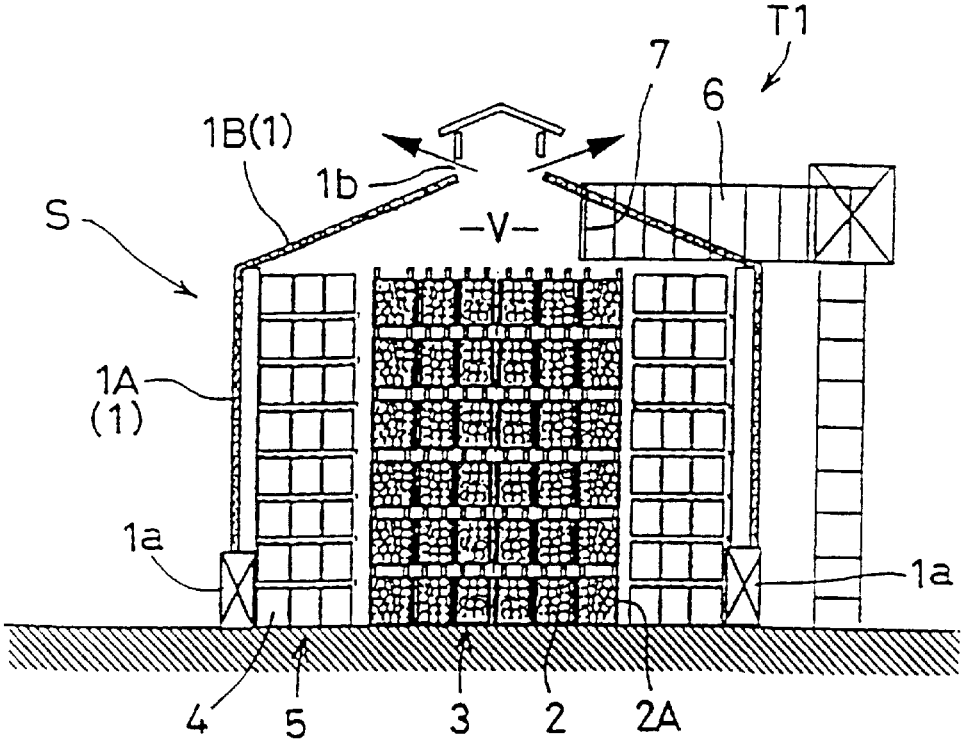

FIGS. 5(*a*) and 5(*b*) show an example of a storage facility relating to the present invention (referred to simply as 'storage facility' hereinafter) T1. The storage facility T1 includes a heat-insulating outer shell 1 made of concrete capable of heat insulating an inner space V, a storage space 3 provided at the center of the inner space V capable of storing agricultural products (an example of storage object), an ice storage water tank disposing space 5 disposed to encompass the storage space 3 for disposing a container (an example of ice storage water tank) 4, and a loading-unloading equipment 6 disposed vertically along a side of the heat insulating outer shell 1 for carrying in and carrying out the articles.

This storage facility T1 is designed mainly for the purposes of storage and precooling of the agricultural products 2 during the harvest time thereof and has a capacity of storing about 1 (one) ton of agricultural products (vegetables in this embodiment).

The heat insulating outer shell 1 includes an outer peripheral wall portion 1A having a cylindrical shape (having an outer diameter of about 6 m) and includes integrally also a roof portion 1B having an umbrella-like shape. The outer peripheral wall portion 1A defines, at a lower region thereof, a plurality of outside-air inlet openings 1*a* which can be opened and closed, with the openings 1*a* being spaced apart from each other along the peripheral direction. The roof portion 1B defines, at a top region thereof, a plurality of inside-air outlet openings 1*b* which can be opened and closed. On a side of the inside-air outlet openings 1*b*, there is provided an entrance exit opening 7 which can be closed and opened for carrying in and carrying out the articles to and from the inner space V by means of the loading-unloading equipment 6.

The storage space 3 has dimensions of about 3 m in the diameter and about 4 m in the height. And, the space accommodates therein pallets or storage frames storing therein the agricultural products 2. In this case, if agricultural product baskets 2A housing the agricultural products 2 therein are employed in the storage frame, they can be housed in the vertically and horizontally stacked condition, thereby to improve the storage efficiency. The storage frames are constructed for allowing free communication of the inside air therethrough so as not to interfere with heat exchange between the inside air of the storage space 3 and the agricultural products 2 or respiration of the agricultural products 2.

The ice storage water tank disposing space 5 is formed in the area between the heat insulating outer shell 1 and the storage space 3 and a number of the containers 4 are stacked or disposed in the vertical and horizontal directions in this space.

Each container 4 is made of plastic and filled with water. And, this container 4 is open at its top for allowing the surface of the water to be exposed. Accordingly, due to the water vapor from the water, the inner space V may be maintained at high humidity and also when the water is frozen, the air of the inner space may be cooled by the heat exchange with the air from this inner space V, thereby to provide a refrigerating environment.

The loading-unloading equipment 6 is constructed of e.g. a lift and a conveyer, so that the equipment is capable of carrying in and carrying out the articles (agricultural product baskets 2A, containers 4 or the like) through the entrance-exit openings 7 to and from the inner space V.

That is, lift-up and lift-down operations of the articles to and from the inner space V may be effected by means of the lifter and horizontal transport of the articles can be done by means of the conveyer.

Incidentally, of the components of the storage facility T1, the heat insulating outer shell 1 and the containers 4 disposed in the ice storage water tank disposing space together constitute an ice maker S.

Next, ice making process using the ice maker S will be described with reference to a conceptual model illustrated in FIG. 3.

The outside-air inlet openings 1*a* and the inside-air outlet openings 1*b* are kept open. With this, in a cold district during winter, a wind (outside air) of sub-zero temperature is introduced, and the temperature of the inner space V too is lowered. In association with this, the water in the lowest-level containers 4 begins to freeze while generating latent heat therefrom. This is represented by the point B in FIG. 2. Thereafter, the condition is gradually shifted to the point A in FIG. 2. In the course of this, since the temperature in the vicinity of the water surfaces of the containers 4 is 0° C. and the temperature at the outside-air inlet openings 1*a* is sub-zero, there is developed a temperature gradient, which results in a negative pressure inside the ice storage water tank disposing space 5 for further promoting introduction of the outside air, that is, there is developed an upward air current. In this manner, as more and more latent heat is generated from the containers of the lowest level, the water in the group of containers 4 stacked in four stages gradually freezes. For more speedy ice making, an air discharge fan may be attached to the inside-air outlet opening 1*b*.

After the water of all of the containers 4 is frozen, the outside-air inlet openings 1*a* and the inside-air outlet openings 1*b* are closed for heat insulation. Even after complete freezing, a portion of the ice becomes water again due to reception of heat from the ground surface, so that the condition inside the containers 4 will be between the point A and the point B in FIG. 2. Therefore, the ice storage water tank disposing space 5 is maintained generally around 0° C.

Further, because of the large contact area between water surfaces of many containers and the air, the water vapor from these water surfaces keep the inner space V under high humidity.

In the above-described manner, ice is made in the containers 4.

Then, for storing the agricultural products 2 in the inner space V, it is confirmed that the temperature of the inner space V is about 0° C. Then, the entrance-exit opening 7 is opened and the agricultural product basket 2A accommodating the agricultural products 2 therein is transported by means of the loading-unloading equipment to an upper portion of the entrance-exit opening 7 and then lowered to the storage space through the entrance-exit opening 7. In this way, the baskets will be stacked and arranged one after another vertically and horizontally.

The storage facility T1 of this embodiment is suitable for storage of vegetables immediately before cold season.

In the spring, summer and autumn seasons, the outside-air inlet openings 1*a* and the inside-air outlet openings 1*b* are closed. Although the outside temperature rises, the effect of the temperature to the agricultural products 2 in the storage space 3 may be limited as the products are protected by the heat insulating outer shell 1 and the ice in the ice storage water tank disposing space 5. Thermodynamically, a cylindrical shape capable of minimizing thawing of the ice during warm seasons will be most reasonable. Because of its circular cross section, the heat transfer area can be minimal, thus, the amount of heat insulating material to be used is minimal as well. This storage method can be enforced without requiring electric energy at all.

[Second Embodiment]

Figure 6:
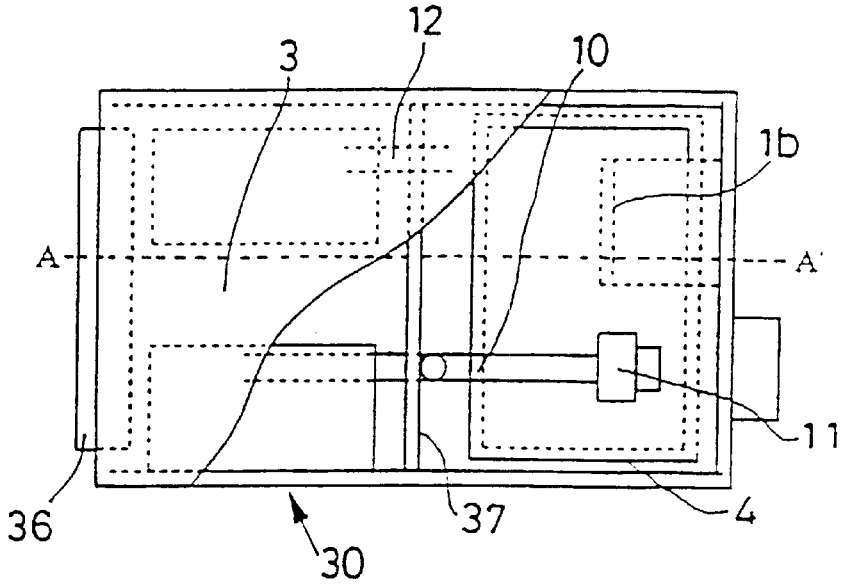
FIG. 6 are construction views of a basic embodiment of a low-temperature, high-humidity storage house for whole-year use; in which (a) is a section along BB' in FIG. 6(*b*) and (b) is a section along AA' in FIG. 6(*a*).
Figure 6:
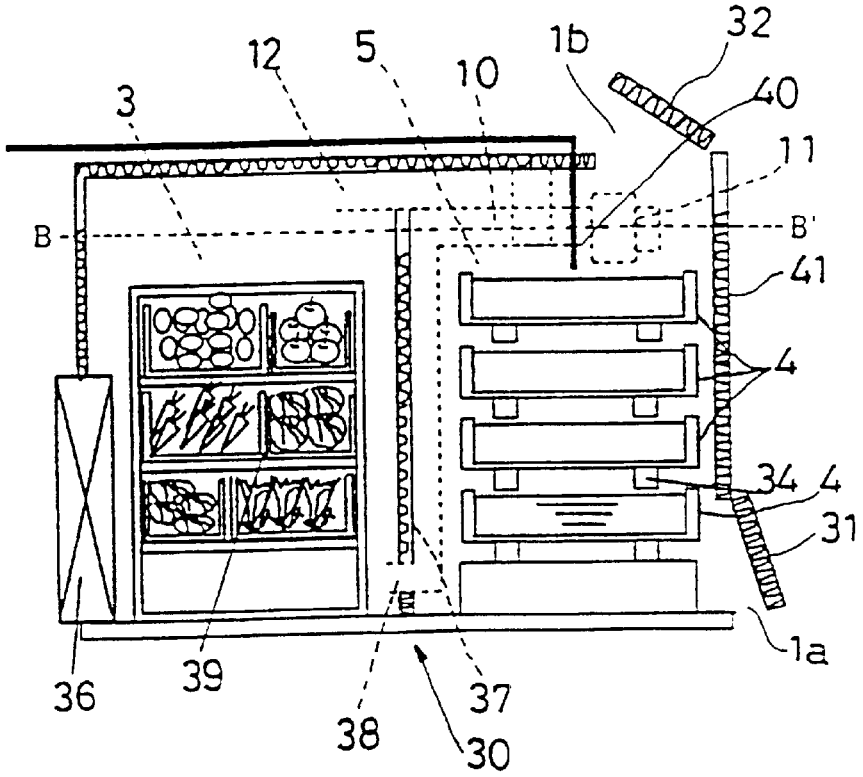

FIG. 6 shows an embodiment capable of storage also during winter when the outside temperature is sub-zero. In this FIG. 6, a building construction 30 having heat insulating structure includes a heat insulating wall 41 and another heat insulating wall 37 interposed between the storage space 3 and the ice storage water tank disposing space 5 so as to prevent direct introduction of sub-zero outside air through the outside air inlet opening 1*a* into the storage space 3. At an upper region inside the ice storage water tank disposing space 5, there is provided a fan 11 for feeding moist air abundantly present in the upper region in the ice storage water tank disposing space 5 via a first flow passage 10 into a cool air inlet opening 38. In the course of this, inside the storage space 3, there occurs respiration by the fresh air introduced from the lower region and the warmed air flows through a return opening 12 formed at an upper portion to be returned into the ice storage water tank disposing space 5.

According to this embodiment, since the ice storage tanks 4 in the ice storage water tank disposing space 5 stores therein a sufficient amount of ice made by heat reception during warm season when the outside temperature is high, the whole-year storage is possible. That is, the thickness of the insulating material is determined, with consideration to the ice storage water amount, respiration heat of the vegetables and the outside temperature so as to assure the coexistence of ice and water in the ice storage water tank disposing space 5, the system may be operated throughout the year, by controlling the air inlet damper 31 and the air outlet damper 32.

It may some times happen that the water in the ice storage water tanks runs short. In such case, a water supply valve 40 may be provided at the uppermost portion of the ice storage water tank 4 for feeding water thereto when such shortage of water has occurred. If the ice storage water tanks are disposed in different levels, water supplied to the upper level may reach the lower level.

Incidentally, the heat insulating building construction 30 includes a carry-in carry-out door 36 and vegetable baskets 39. Also, spacers 34 are provided between the ice storage water tanks 4.

Figure 7:
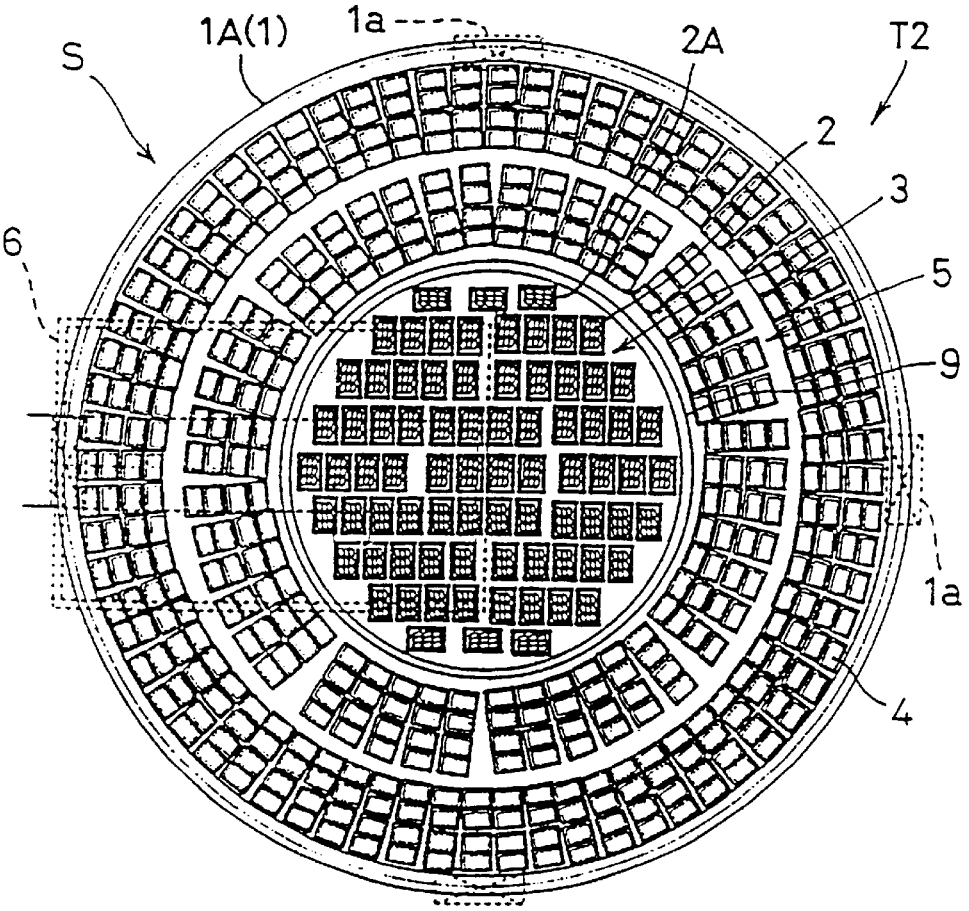
FIG. 7 are explanatory views illustrating a storage facility relating to a second embodiment; in which (a) is a plan view and (b) is a side view in section.
Figure 7:
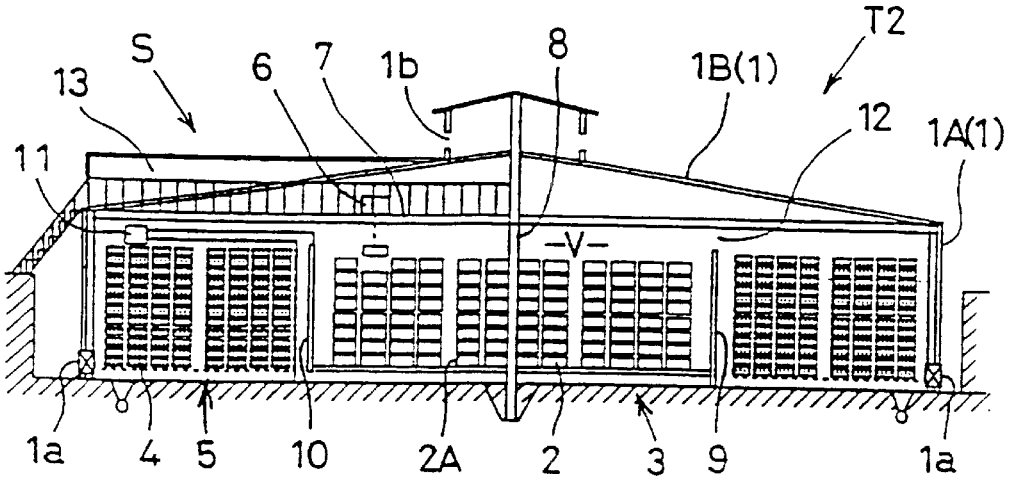

FIG.7 shows a storage facility T1 capable of large-scale, whole-year, long-term low-temperature and high-humidity storage with cool air flow with low energy consumption.

The constructions of those components which will not be particularly described are identical to those in the first embodiment.

The storage facility T2 has an outer diameter of 34 m, an inner diameter of 28 m and a height of 6 m. The lower half of the storage facility T2 is disposed under ground. With this, the system may utilize the natural heat insulating effect. Also, the center of the roof is supported by a support column 8.

Referring to the inside of the storage facility T2, the ice storage water tank disposing space 5 is disposed in such a manner as to encompass the storage space 3, with these two spaces 5, 3 being partitioned from each other by a heat insulating wall 9. And, the storage facility T2 includes a first flow passage 10 communicated with the upper end portion of the ice storage water tank disposing space 5 and the lower end portion of the storage space 3, a fan 11 for feeding air present at the upper end portion of the ice storage water tank disposing space 5 via the first flow passage 10 to the lower end portion of the storage space 3, and a return opening 12 for allowing air to escape from the storage space 3 into the ice storage water tank disposing space 5 when the air is fed by the fan 11.

Accordingly, as the fan 11 is drive to feed air, there occurs circulation of air present in the ice storage water tank disposing space 5 and the storage space 3, thereby to restrict rise of temperature in the storage space 3 for maintaining good refrigerating condition.

Further, at a portion of the roof portion, there is sectioned an antisweating chamber 13, in order to prevent dew concentration on the surface of the agricultural product due to sharp temperature change when the agricultural product 2 stored in the storage facility T2 is taken out of the system. That is, the temperature of the antisweating chamber 13 is set to be between the temperature of the storage space 3 and the outside temperature, so that the temperature may become closer to the outside temperature gradually. Incidentally, at the partitioning portion between the antisweating chamber 13 and the inner space V, the entrance-exit opening 7 is formed.

The storage capacity of the storage facility T2 according to this embodiment is set to 1,000 tons, in case the system stores potatoes therein.

Next, there will be described how the storage facility T2 operates to cope with the three periods, i.e. the ice making period, cold period and warm period. The cold period refers to a period when the outside temperature is below 0° C. and the warm period refers to a period when the outside temperature is above 0° C., respectively.

Referring to the ice making period, water is stored in all of the containers 4. If the outside temperature is below 0° C., then ice making starts by the outside-air inlet openings 1*a* and the inside-air outlet openings 1*b* disposed above. Water begins to freeze, starting from the lower portions of the containers 4 filled with water and stacked one above another in the ice storage water tank disposing space 5, with latent heat being generated from the water during the process. Then, there is established coexistence of ice and water inside the ice storage water tank disposing space 5. The moist air (temperature: 0° C., humidity: nearly 100%) generated inside the ice storage water tank disposing space 5 is caused by the fan 11 to enter the first flow passage 10 to be introduced from the lowermost area of the storage space 3. At the upper portion, there is provided the inside-air outlet opening 1*b*. The fan 11 is very effective for such large-scale storage of vegetables.

In the warm period, the outside air outlet openings 1*a* are completely closed, and the air of the ice storage water tank disposing space 5 is fed from the lower area of the space by the fan 11 into the storage space 3. The air present in the upper area of the ice storage water tank disposing space 5 may be fed to the lower are of the storage space. By means of the fan 11, the air present inside the ice storage water tank disposing space is fed through the first flow passage 10 into the storage space. The air present inside the storage space 3 is returned to the return opening 12 to be reused. Even when the outside temperature rises, because of the protection afforded by the heat insulating and abundant ice, i.e. because of the large heat capacity, the environment of 0° C. temperature and 100% humidity may be maintained as long as the coexistence of ice and water continues to exist.

In the cold period, the outside-air outlet openings 1*a* are opened and the latent heat escapes through the inside-air outlet openings 1*b,* so that freezing begins. The air present at the upper area of the ice storage water tank disposing space 5 is sent through the first flow passage 10 into the storage space 3. The air past through the storage space 3 is discharged to the outside.

In the manner described above, the storage facility according to this embodiment can constantly provide the environment of 0° C. temperature and 90% or higher humidity as long as the coexistence of ice and water is maintained.

Figure 1:
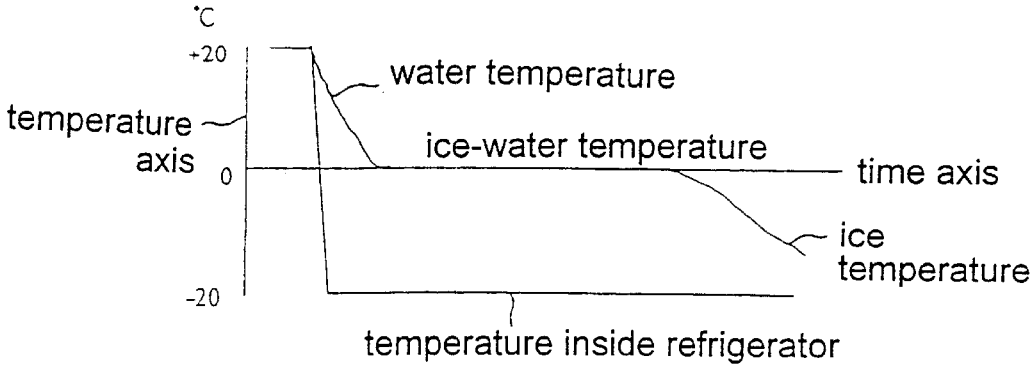
FIG. 1 is an explanatory view illustrating latent heat of water.
Figure 1:
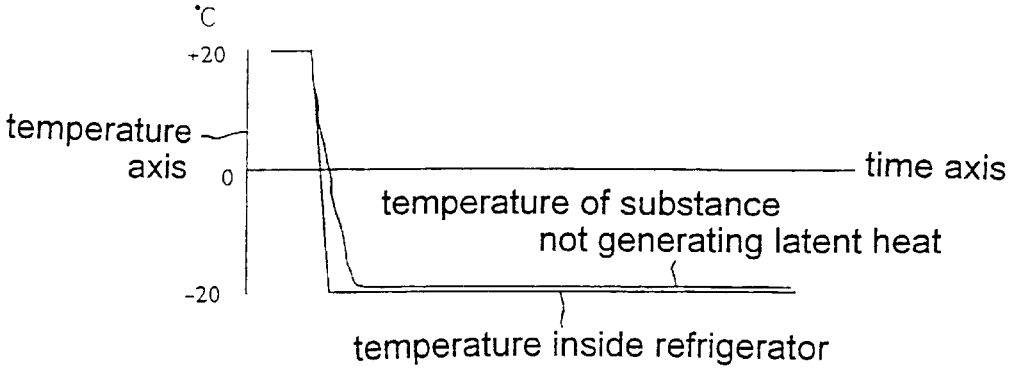
Figure 2:
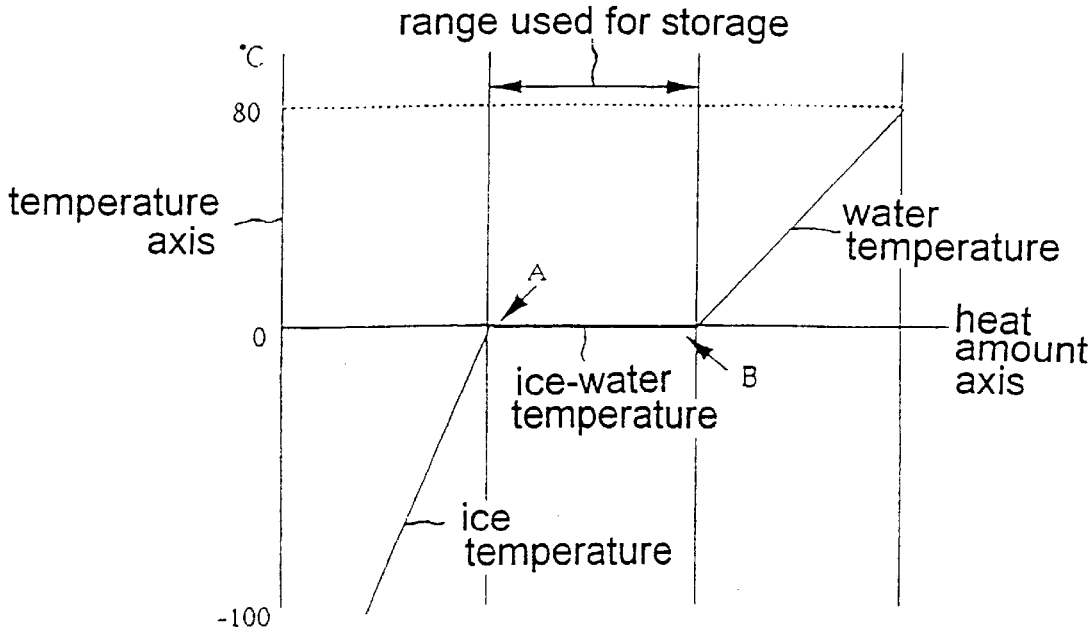
FIG. 2 is an explanatory view illustrating relationship between heat capacity and temperature of water.

As shown in FIG. 2, as long as the coexistence of ice and water remains, the temperature inside the space is maintained at 0° C. The temperature inside the storage space 3 is constantly monitored by a temperature sensor, so that the fan 11 can supply 0° C. air as needed. The vegetables respire, thus generate heat. By utilizing this together with the ground surface as the heat source, it is possible to set the temperature slightly above 0° C., for example at 2° C. However, since the vegetables take in oxygen and discharge carbon dioxide gas, there occurs shortage of oxygen inside the storage space 3. In order to prevent this, a trace amount of fresh air is introduced intermittently through the outside air inlet openings 1*a*. The amount of heat generated in association with this introduction of air is so small as not to noticeably affect the temperature of the storage space 3.

If the storage facility T2 according to this embodiment of the present invention is used, the vegetables, or agricultural products such as vegetables or fruits can be shipped by any desired amount and any time, since the system provides the low-temperature, high-humidity condition throughout the year. Because of this, it may be expected to achieve stabilization of prices of vegetables on the market.

[Third Embodiment]

Figure 8:
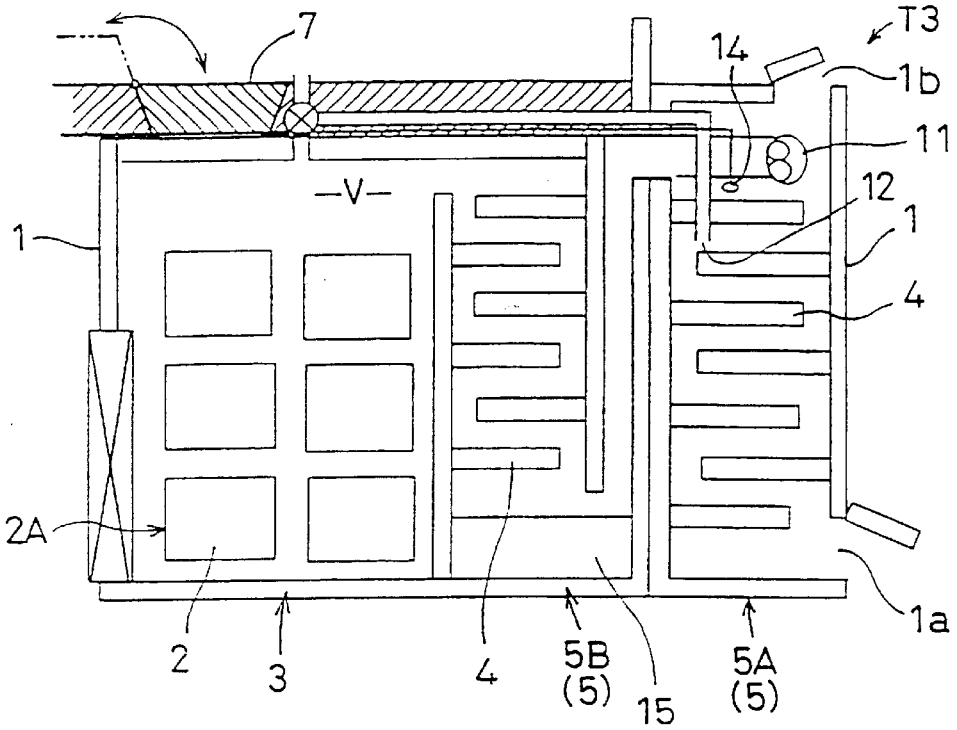
FIG. 8 is a conceptual view in side view showing a storage facility relating to a third embodiment.

FIG. 8 is an embodiment wherein a storage facility T3 is installed in a house.

Incidentally, the constructions of those parts not particularly described are identical to those in the first and second embodiments described above.

Inside a heat insulating outer shell 1, there are provided a first ice storage water tank disposing space 5A capable of communicating with the outside, a storage space 3, and a second ice storage water tank disposing space 5B interposed between the first ice storage water tank disposing space 5A and the storage space 3. The heat insulating outer shell 1 is formed such that the first ice storage water tank disposing space 4A is disposed outdoors and the storage space 3 and the second ice storage water tank disposing space 5B are disposed indoors.

In the instant embodiment, the heat insulating outer shell 1 has a cubic shape.

In the storage space 3, steel containers 4 capable of resisting freezing and thawing of ice are installed in different levels. Upwardly thereof, a water supply nozzle 14 of tap water is provided for automatically feeding water from the above.

Downwardly of the first ice storage water tank disposing space 5A, there is provided an outside-air inlet opening 1*a* and upwardly of the same there is provided an inside-air outlet opening 1*b,* with the respective openings being openable and closable.

Also, upwardly of the storage space, there is provided an entrance-exit opening 7.

Upon completion of ice making in the first ice storage water tank disposing space 5A, the outside air inlet opening 1*a* and the inside air outlet opening 1*b* are closed By means of the fan 11, 0° C. air is introduced through the second ice storage water tank disposing space 5B into the storage space 3. Although this storage facility T3 is surrounded by insulating material, the inside of the storage space 3 tends to be warmed by the heat generated for heating the house. This air is flows through the return opening 12 provided above the storage space 3 back into the first ice storage water tank disposing space 5A. The temperature inside the storage space 3 is constantly monitored and the temperature control can be effected by means of the fan 11, or the water supply nozzle 14, a freezer 15 disposed at a lower portion of the second ice storage water tank disposing space.

In this way, in case the storage space 3 is limited or when the cold source needed for ice making is insufficient as is the case with a warm district, it is also possible to provide a freezer 15 for making up for the deficiency of ice making. The electricity for this freezer may be provided by utilizing inexpensive midnight power.

Incidentally, according to this embodiment, the ice storage water tank disposing space 5 includes the first ice storage water tank disposing space 5A and the second ice storage water tank disposing space 5B. With this construction, it becomes possible not only to further increase the humidity of the air to be fed into the storage space 3, but also to elevate to the vicinity of 0° C. the temperature of the air fed into the second ice storage water tank disposing space by means of latent heat of the water even when the temperature of the air present inside the first ice storage water tank disposing space is low such as sub-zero during the ice making period.

Therefore, the storage facility T3 according to the present embodiment can be used most suitably for storage of flowers also. If the ice storage water tank disposing space is insufficient within a shop, it is possible to minimize the cutting of flows or waste of flows by utilizing midnight power in combination. Further, if the invention is utilized for a limited period from the winter season to the early spring, since sufficient amount of cold water is stored in the ice storage water tank disposing space, the return opening 12 may be utilized for cooling the inside of the house.

[Fourth Embodiment]

Figure 9:
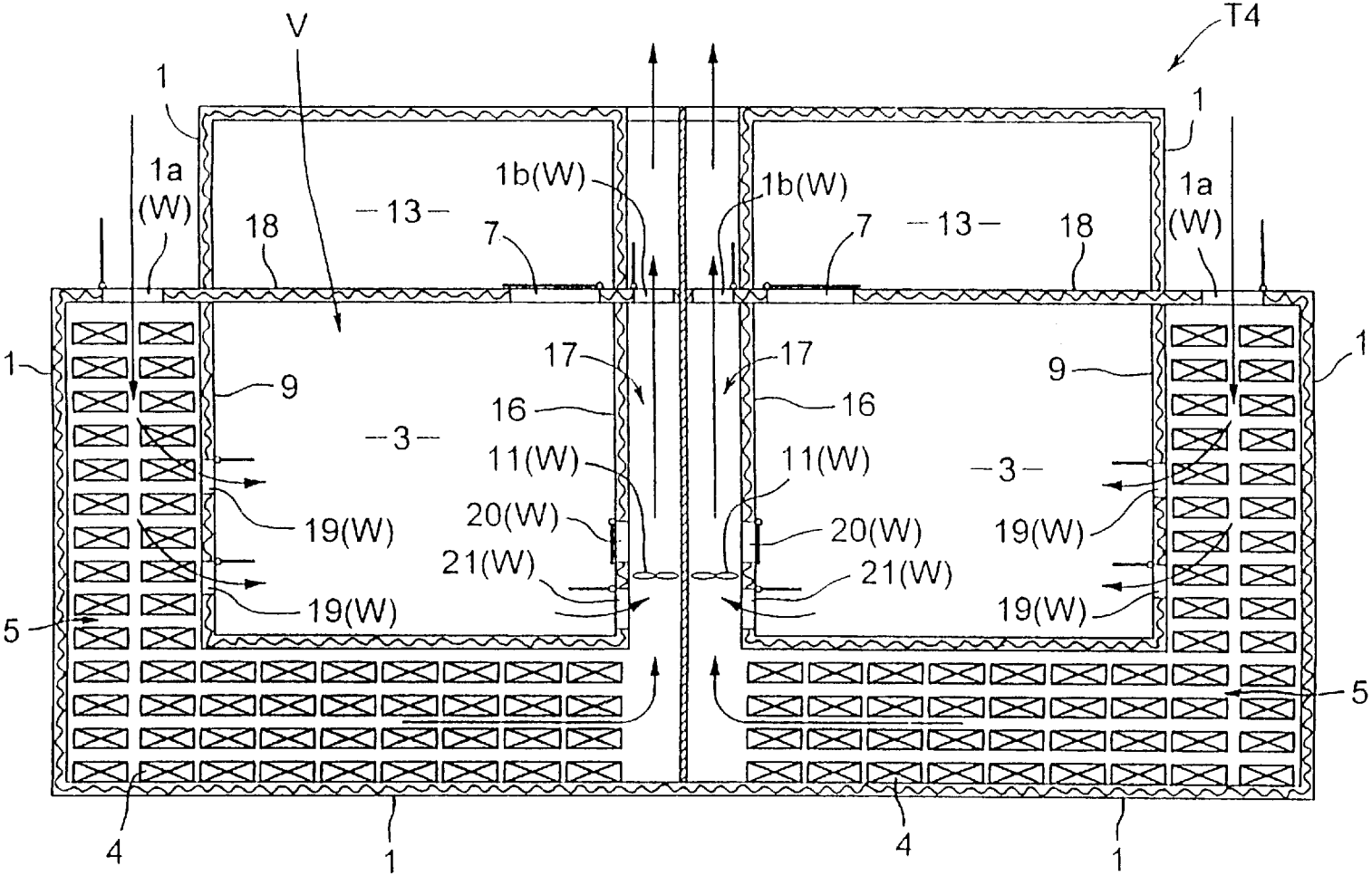
FIG. 9 is a conceptual view in side view showing a storage facility relating to a fourth embodiment.
Figure 10:
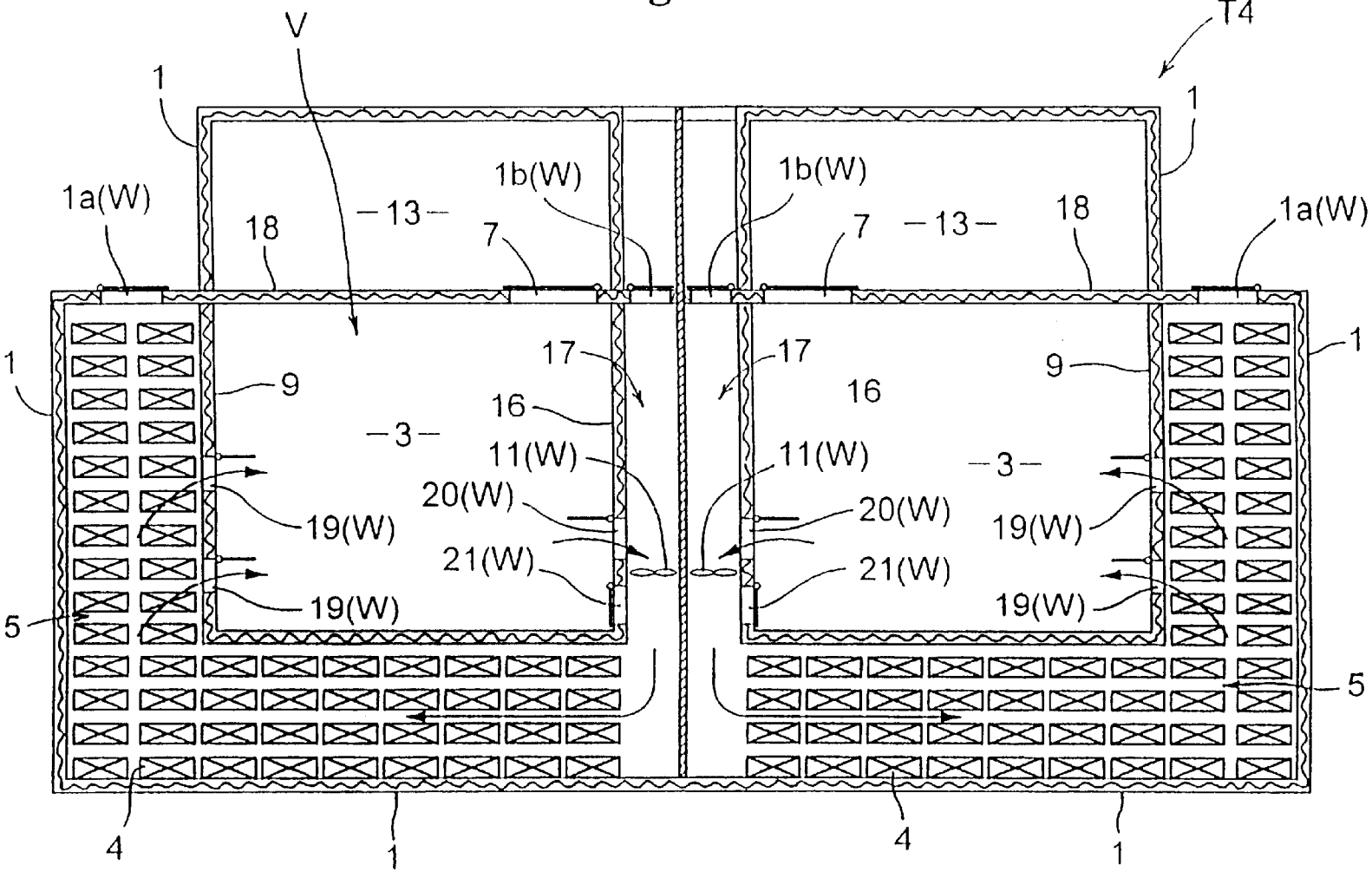
FIG. 10 is a conceptual view in side view showing a storage facility relating to a fourth embodiment.

FIGS. 9 and 10 show a storage facility T4 capable of large-scale, whole-year, long-term low-temperature and high-humidity storage with cool air flow with low energy consumption.

Incidentally, the constructions of those parts not particularly described are identical to those in the first, second and third embodiments described above.

Inside the storage facility T4, the ice storage water tank disposing space 5 is arranged so as to surround the lateral and lower sides of the storage space 3 and these spaces 5, 3 are separated from each other by means of a heat insulating wall 9.

And, a vertical shaft section 17 partitioned from the storage space 3 by means of a heat insulating wall 16 is provided at the center of the inner space V. The lower end portion of this vertical shaft section 17 is communicated with the ice storage water tank disposing space 5. Further, at the upper end portion of the vertical shaft section 17, there is formed an inside air outlet opening 1*b* which is openable and closable. Further, at the vertically intermediate portion of the vertical shaft section 17, the fan 11 is attached. This fan 11 is selectively operable to feed air in the forward and reverse directions.

Upwardly of the storage space 3, there is provided an antisweating chamber 13. And, a heat insulating wall 18 interposed between the storage space 3 and the antisweating chamber 13 includes an entrance-exit opening 7 which can be closed and opened for carrying in and carrying out the agricultural products 2 to and from the storage space 2.

A heat insulating wall 9 vertically interposed between the ice storage water tank disposing space 5 and the storage space 3 includes, at a vertically intermediate portion thereof, a first opening 19 capable of introducing a portion of the outside air taken into the ice storage water tank disposing space 5 through the outside air inlet opening 1*a* into the storage space 3. A heat insulating wall 16 vertically interposed between the storage space 3 and the vertical shaft section 17 includes, at positions respectively upwardly and downwardly of the position where the fan 11 is attached, second and third openings 20, 21 capable of discharging the air present in the storage space 3 into the vertical shaft section 17.

Incidentally, the fan 11, first opening 19, second opening 20, third opening 21, outside air inlet opening 1*a* and the inside air inlet opening 1*b* together constitute a blower means W.

Next, there will be described how the storage facility T4 operates to cope with the three periods, i.e. the ice making period, cold period and warm period. The cold period refers to a period when the outside temperature is below 0° C. and the warm period refers to a period when the outside temperature is above 0° C., respectively.

Referring to the ice making period, as shown in FIG. 9, water is stored in all of the containers 4. If the outside temperature is below 0° C., then ice making starts by opening the outside-air inlet openings 1*a* and the inside-air outlet openings 1*b* and driving the fan 11 in the condition for feeding the inside air to the inside air outlet side (referred to as 'downstream side' hereinafter). Water begins to freeze, with latent heat being generated from the upper containers 4 of the containers filled with water and disposed vertically and horizontally in the ice storage water tank disposing space. Thus, there is gradually established co-existence of ice and water inside the ice storage water tank disposing space 5.

Then, during cold reason, as shown in FIG. 9, by opening the first opening 19 and the second opening 21 in accordance with the air communication during the ice making period described above, the low-temperature air of about 0° C. which has taken latent heat away from the water in the containers 4 is introduced into the storage space 3 also, whereby the refrigerating condition may be maintained. Accordingly, in this condition, regarding the flow of air from the outside air inlet openings 1*a* to the inside air outlet openings 1*b*, there are simultaneously generated a flow from the ice storage water tank disposing space 5 through the storage space 3 to the vertical shaft 17 and another flow from the ice storage water tank disposing space 5 to the vertical shaft.

Incidentally, when the temperature inside the storage space 3 is below 0° C., it is possible to maintain appropriate temperature by closing the first opening 19 and the third opening 21.

During warm season, as illustrated in FIG. 10, the outside air inlet openings 1*a* and the inside air outlet openings 1*b* are completely closed. Then, by opening the first opening 19 and the second opening 20 and driving the fan 11 to feed air in the opposite direction from the downstream direction, the air which has become about 0° C. from the vertical shaft 17 through the ice storage water tank disposing space 5 is fed via the first opening 19 into the storage space 3, so as to maintain the indoor temperature of the storage space 3 at an appropriate temperature. The air inside the storage space 3 is returned through the second opening 20 to the vertical shaft 17 for recirculation.

Incidentally, the driving heat generated in association with the driving of the fan 11, though being small in the amount, is cooled as it passes the ice storage water tank disposing space 5, so that its adverse effect to the inside of the storage space 3 may be avoided.

Therefore, even when the outside temperature rises, because of the protection afforded by the heat insulation and abundant ice water, that is, the large heat capacity, the environment of 0° C. temperature and 100% humidity may be maintained as long as the coexistence of ice and water remains.

Further, since the temperature distribution inside the storage space 3 may be reduced by means of the air current generated by the fan 11, the system is very effective in particular for a large-scale storage of agricultural products.

As described above, according to the storage system of the present embodiment, the system constantly provides the environment of humidity of 90% or more, as long as the coexistence of ice and water is maintained.

As shown in FIG. 2, as long as the coexistence of ice and water remains, the temperature inside the space is maintained at 0° C. The temperature inside the storage space 3 is constantly monitored by a temperature sensor, so that the fan 11 can supply 0° C. air as needed. The vegetables respire, thus generate heat. By utilizing this together with the ground surface as the heat source, it is possible to set the temperature slightly above 0° C., for example at 2° C. However, since the vegetables take in oxygen and discharge carbon dioxide gas, there occurs shortage of oxygen inside the storage space 3. In order to prevent this, a trace amount of fresh air is introduced intermittently through the outside air inlet openings 1*a*. The amount of heat generated in association with this introduction of air is so small as not to noticeably affect the temperature of the storage space 3.

Further, since the agricultural products introduced into the storage space 3 are rapidly refrigerated under the 0° C. environment, it is possible to cause the cell tissues of the agricultural products to contract for restricting moisture evaporation and/or respiration, thereby to prevent quality deterioration thereof. That is, the so-called "precooling" may be effected in an ideal manner.

If the storage facility T4 according to this embodiment of the present invention is used, the vegetables can be shipped by any desired amount and any time, since the system provides the low-temperature, high-humidity condition throughout the year. Because of this, it may be expected to achieve stabilization of prices of vegetables on the market.

Next, other embodiments will be described.

<1> The storage objects are not limited to the agricultural products described in the foregoing embodiments. They may be e.g. beef, pork, poultry, frozen fish meat, etc. These will be generically referred to as storage objects. Further, regarding storage, it is not limited to refrigerated storage, but it may include frozen storage as well.

<2> The ice storage water tank is not limited to the container made of plastic or steel described in the foregoing embodiment. It may be one made of metal or ceramic or may comprise a bag made of synthetic resin. Further, as for the ice storage water tank, by forming it in a shape proving a large water surface area, such as a fan shape, it is possible to promote heat exchange between the air in the storage space and the water, thus achieving efficient ice making.

<3> The storage system is maintained long in the closed condition during the period thereof storing the storage objects 2 in the storage space 3. Then, in case it is used for storage of objects 2 which respire, there tends to occur shortage of oxygen in the inner space V. In order to prevent this, it is preferred to provide a control mechanism for automatically determining the oxygen concentration in the inner space V and periodically introducing fresh air by timer control scheme.

Figure 11:
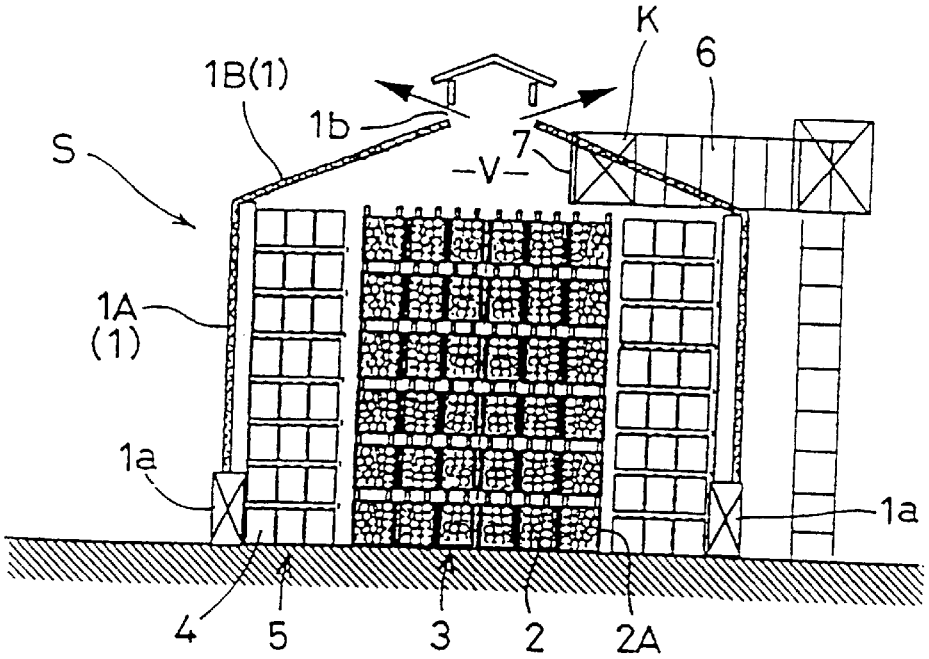
FIG. 11 is a conceptual view showing a storage facility relating to a further embodiment.

<4> In the foregoing embodiments, the storage objects 2 under the room temperature are directly introduced and stored in the storage space. Instead, as shown in FIG. 11 for example, if a rapid cooling means K is provided adjacent the entrance-exit opening 7 for causing the storage object 2 to come into contact with cold air or cold water for rapidly cooling the same, the storage object 2 may be rapidly cooled before its storage at the storage space 3, whereby the freshness of the storage object may be maintained easily.

Figure 12:
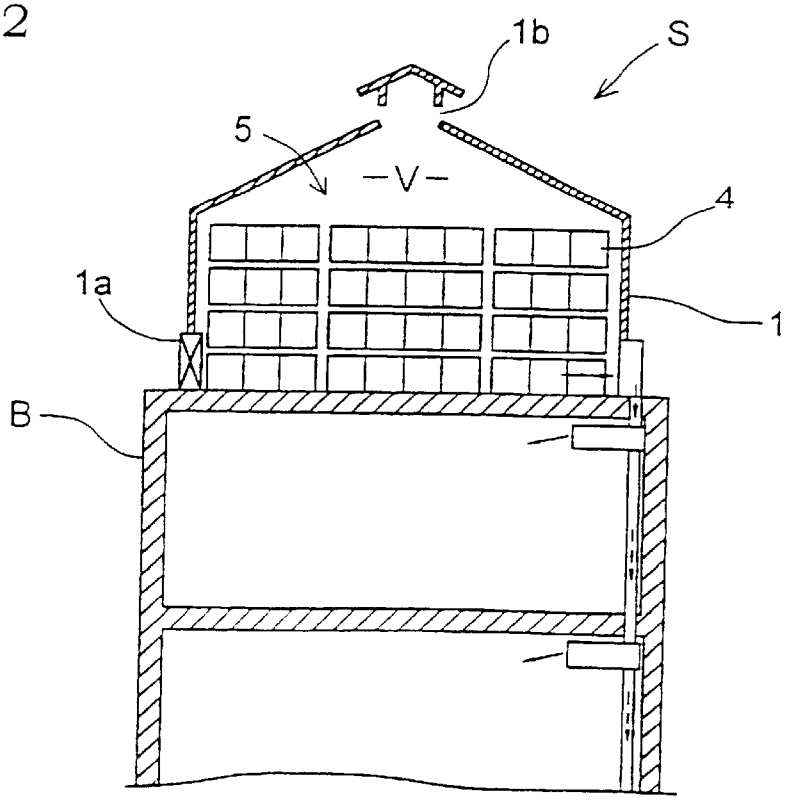
FIG. 12 is a conceptual view showing a storage facility relating to a still further embodiment.

<5> The ice maker S is not limited to the one described in the foregoing embodiments, dedicated for the storage system. Instead, as shown in FIG. 12 for instance, it may be provided to the building construction B, so that the cold of the ice made during cold season may be utilized as a means for cooling the building during warm seasons. Needless to say, when a large amount of ice storage water tank disposing space can be assured, it is possible to make a large amount of ice, so that the cold of the ice storage water tank disposing space may be utilized for both the storage system and cooling of the building.

<6> The heat insulating outer shell 1 is not limited to the one described in the foregoing embodiments having the cylindrical shape. Instead, it may be modified into e.g. dome-shaped, spherical, or a polygonal plan shape, etc.

INDUSTRIAL APPLICABILITY

As described above, the storage system and storage method relating to the present invention are suitable for low-temperature high humidity storage of agricultural products such as potato, vegetables, and fruits and for precooling of vegetables.

What is claimed is:

1. A storage system comprising:

a heat-insulating outer shell capable of insulating an inner space;

an ice storage water tank capable of storing water therein disposed in an ice storage water tank disposing space provided in the inner space of the heat-insulating outer shell;

a storage space for storing objects to be stored provided in the inner space of the heat-insulating outer shell;

an outside-air inlet opening provided at a lower portion of the heat-insulating outer shell, the inlet opening capable of introducing outside air into the inner space;

an inside-air outlet opening provided at an upper portion of the heat-insulating outer shell, the outlet opening capable of discharging inside air from the inner space of the heat-insulating outer shell to the outside; and an object entrance-exit opening provided at an upper portion of the heat-insulating outer shell for allowing entrance-exit of the objects to and from the storage space, wherein when the storage system is utilized in a cold weather environment, the outside-air inlet and inside-air outlet may be selectively opened to pass substantially sub-zero ambient air through the inner space to freeze the water that may be stored in the ice storage water tank.

2. The storage system according to claim 1, wherein the heat-insulating outer shell has a cylindrical shape.

3. The storage system according to claim 1, wherein the ice storage water tank disposing space is disposed so as to encompass the storage space.

4. The storage system according to claim 1, further comprising a loading-unloading device capable of transporting the storage object through the entrance-exit opening.

5. The storage system according to claim 2, wherein the ice storage water tank disposing space is disposed so as to encompass the storage space.

6. The storage system according to claim 2, further comprising a loading-unloading device capable of transporting the storage object through the entrance-exit opening.

7. The storage system according to claim 3, further comprising a loading-unloading device capable of transporting the storage object through the entrance-exit opening.

8. A storage system comprising:

a heat-insulating outer shell capable of insulating an inner space;

an ice storage water tank capable of storing water therein disposed in an ice storage water tank disposing space provided in the inner space of the heat-insulating outer shell;

a storage space for storing objects to be stored provided in the inner space of the heat-insulating outer shell;

an outside-air inlet opening provided at a lower portion of the heat-insulating outer shell, the inlet opening capable of introducing outside air into the inner space of the heat insulating outer shell; and an inside-air outlet opening provided at an upper portion of the heat-insulating outer shell, the outlet opening capable of discharging inside air from the inner space of the heat-insulating outer shell to the outside, wherein the ice storage water tank disposing space is disposed so as to encompass the storage space, and wherein when the storage system is utilized in a cold weather environment, the outside-air inlet and inside-air outlet may be selectively opened to pass substantially sub-zero ambient air through the inner space to freeze the water that may be stored in the ice storage water tank.

9. The storage system according to claim 8, wherein the heat-insulating outer shell has a cylindrical shape.

10. A storage system comprising:

a heat-insulating outer shell capable of insulating inner space;

an ice storage water tank capable of storing water therein disposed in an ice storage water tank disposing space provided in the inner space of the heat-insulating outer shell;

a storage space for storing objects to be stored provided in the inner space of the heat-insulating outer shell;

an outside-air inlet opening provided at a lower portion of the heat-insulating outer shell, the inlet opening capable of introducing outside air into the inner space; and an inside-air outlet opening provided at an upper portion of the heat-insulating outer shell, the outlet opening capable of discharging inside air from the inner space of the heat-insulating outer shell to the outside, wherein the heat-insulating outer shell has a cylindrical shape, wherein when the storage system is utilized in a cold weather environment, the outside-air inlet and inside-air outlet may be selectively opened to pass substantially sub-zero ambient air through the inner space to freeze the water that may be stored in the ice storage water tank.

11. A storage system comprising:

a heat-insulating outer shell capable of insulating inner space;

an ice storage water tank capable of storing water therein disposed in an ice storage water tank disposing space provided in the inner space of the heat-insulating outer shell;

a storage space for storing objects to be stored provided in the inner space of the heat-insulating outer shell;

an outside-air inlet opening provided at a lower portion of the heat-insulating outer shell, the inlet opening being capable of introducing outside air into the inner space of the heat insulating outer shell;

an inside-air outlet opening provided at an upper portion of the heat-insulating outer shell, the outlet opening being capable of discharging inside air from the inner space of the heat-insulating outer shell to the outside;

an object entrance-exit opening provided at an upper portion of the heat-insulating outer shell for allowing entrance-exit of the objects to and from the storage space; and a blower means capable of being driven to selectively provide an outside air introducing state for introducing outside air through the outside-air inlet opening into the ice storage water tank disposing space and an inside air circulating state for circulating the air between the ice storage water tank disposing space and the storage space, wherein when the storage system is utilized in a cold weather environment, the outside-air inlet and inside-air outlet may be selectively opened to pass substantially sub-zero ambient air through the inner space to freeze the water that may be stored in the ice storage water tank.

12. A storage method comprising the steps of:

providing a storage space, comprising:

a heat-insulating outer shell capable of insulating an inner space;

an ice storage water tank capable of storing water therein disposed in an ice storage water tank disposing space provided in the inner space of the heat-insulating outer shell;

a storage space for storing objects to be stored provided in the inner space of the heat-insulating outer shell;

an outside-air inlet opening provided at a lower portion of the heat-insulating outer shell, the inlet opening capable of introducing outside air into the inner space;

an inside-air outlet opening provided at an upper portion of the heat-insulating outer shell, the outlet opening capable of discharging inside air from the inner space of the heat-insulating outer shell to the outside; and an object entrance-exit opening provided at an upper portion of the heat-insulating outer shell for allowing entrance-exit of the objects to and from the storage space;

charging water into the ice storage water tank;

when outside air becomes sub-zero temperature, rendering the outside-air inlet opening and the inside-air outlet opening communicable so as to introduce the outside air into the ice storage water tank disposing space, and such that the sub-zero temperature of the outside air may freeze the water for maintaining ambient temperature of the storage space at a refrigeration condition; and while the outside-air inlet opening is kept closed, introducing the storage object through the entrance-exit opening into the storage space to be stored therein, wherein when the storage system is utilized in a cold weather environment, the outside-air inlet and inside-air outlet may be selectively opened to pass substantially sub-zero ambient air through the inner space to freeze the water that may be stored in the ice storage water tank.

* * * * *

UNITED STATES PATENT AND TRADEMARK OFFICE

CERTIFICATE OF CORRECTION

PATENT NO. : 6,418,746 B1
DATED : July 16, 2002
INVENTOR(S) : Jun Dokoshi

It is certified that error appears in the above-identified patent and that said Letters Patent is hereby corrected as shown below:

Title page,
Item [73], Assignee, "Daicolo Co., Ltd., Osaka (JP)" should read -- Daicolo Co., Ltd., "part interest," Osaka (JP), Hitoshi Dokoshi, "part interest", Sapporo-shi (JP) --

Signed and Sealed this

Eighteenth Day of March, 2003

JAMES E. ROGAN
*Director of the United States Patent and Trademark Office*